US005127321A

United States Patent [19]

Proffer

[11] Patent Number: 5,127,321

[45] Date of Patent: Jul. 7, 1992

[54] METHOD AND APPARATUS FOR PRE-REGISTRATION OF MULTIPLE PRINTING SCREENS IN A SCREEN PRINTING OPERATION

[75] Inventor: James D. Proffer, Burton, Mich.

[73] Assignee: Silk Screen Technologies, Inc., Flint, Mich.

[21] Appl. No.: 527,043

[22] Filed: May 22, 1990

[51] Int. Cl.[5] ..... B41F 15/10

[52] U.S. Cl. ..... 101/115; 101/126; 101/114; 101/123

[58] Field of Search ..... 101/114, 115, 116, 117, 101/118, 121, 122, 123, 124, 125, 126, 127, 127.1, 128, 128.1, 128.21, 128.4, 129

[56] References Cited

U.S. PATENT DOCUMENTS

| | | | |
|---|---|---|---|
| 1,098,289 | 5/1914 | Mullaly | 101/390 |
| 1,857,842 | 5/1932 | Goldenbaum | 101/401.1 |
| 1,892,268 | 12/1932 | Flockhart | 101/415.1 |
| 2,487,542 | 7/1944 | Haff | 30/358 |
| 2,796,831 | 6/1957 | Heestand | 101/126 |
| 2,854,922 | 10/1958 | Leibenguth | 101/127.1 |
| 3,356,023 | 12/1967 | Schuttenberg | 101/128.3 |
| 3,427,964 | 2/1969 | Vasilantone | 101/115 |
| 3,460,470 | 8/1969 | Green et al. | 101/115 |
| 3,643,597 | 2/1972 | Lala | 101/128.21 |
| 3,927,943 | 12/1975 | Pohl et al. | 355/91 |
| 3,943,851 | 3/1976 | Inada et al. | 101/127.1 |
| 4,054,091 | 10/1977 | Bradley | 101/129 |
| 4,084,504 | 4/1978 | Fuchs | 101/115 |
| 4,179,990 | 12/1979 | Radencic | 101/467 |
| 4,226,181 | 10/1980 | Ericsson | 101/129 |
| 4,315,461 | 2/1982 | Harpold | 101/115 |
| 4,381,706 | 5/1983 | Harpold | 101/127.1 |
| 4,404,903 | 9/1983 | Cronin | 101/123 |
| 4,473,007 | 9/1984 | Colineau | 101/127.1 |
| 4,474,109 | 10/1984 | Yara | 101/115 |
| 4,516,495 | 5/1985 | Ericsson | 101/129 |
| 4,606,268 | 8/1986 | Jaffa | 101/115 |
| 4,669,378 | 6/1987 | Lee | 101/115 |
| 4,671,174 | 6/1987 | Tartaglia et al. | 101/115 |
| 4,708,057 | 11/1987 | Hogenson | 101/129 |
| 4,729,306 | 3/1988 | Bubley | 101/114 |
| 4,738,909 | 4/1988 | Jennings | 430/20 |
| 4,938,130 | 7/1990 | Thorpe | 101/126 |
| 4,949,635 | 8/1990 | Padula | 101/115 |

*Primary Examiner*—Edgar S. Burr
*Assistant Examiner*—Joseph R. Keating
*Attorney, Agent, or Firm*—Harness, Dickey & Pierce

[57] ABSTRACT

A method and apparatus for pre-registering a set of multi-color print screens prior to installation into a registration apparatus of a screen printing machine.

3 Claims, 5 Drawing Sheets

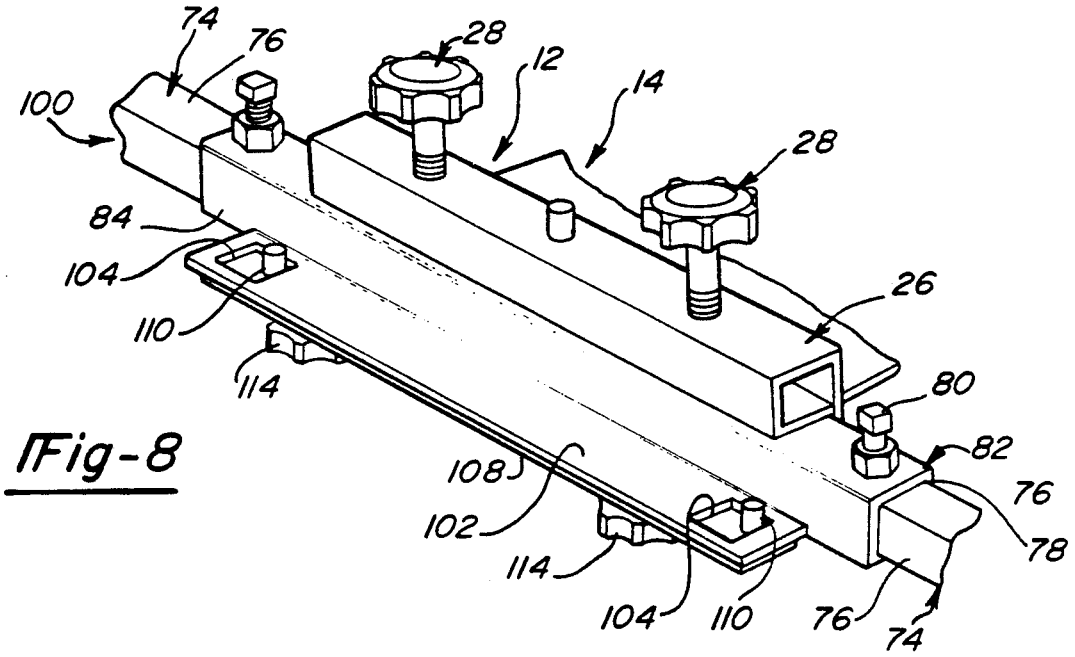
Fig-8
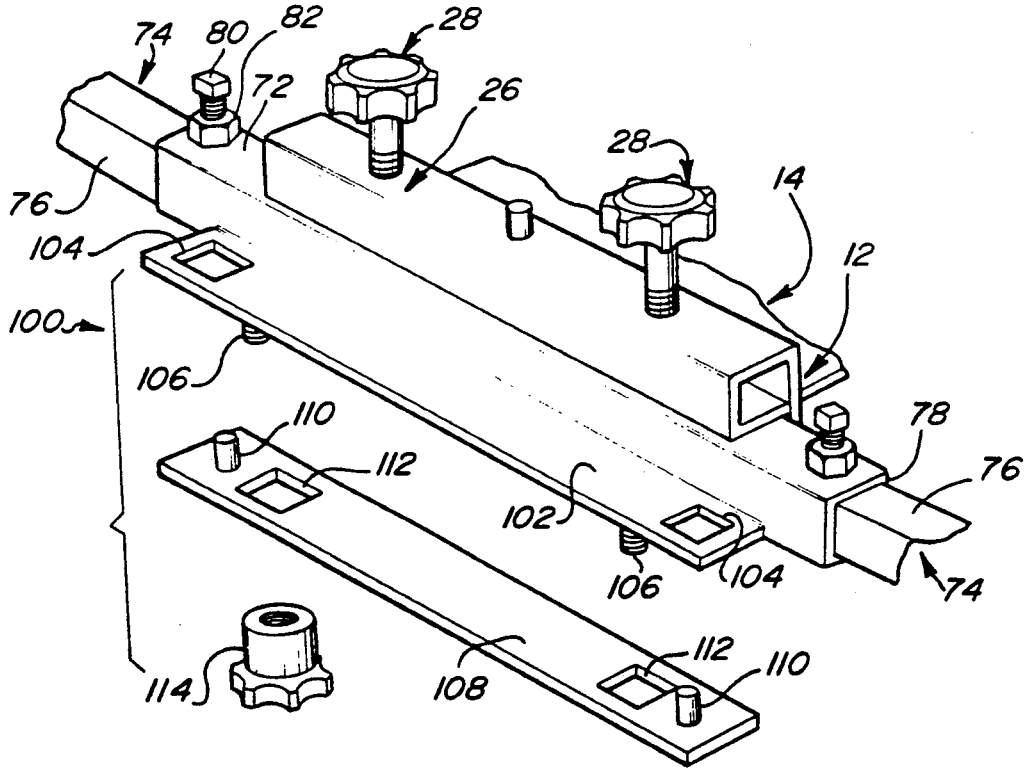
Fig-9
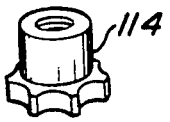

METHOD AND APPARATUS FOR PRE-REGISTRATION OF MULTIPLE PRINTING SCREENS IN A SCREEN PRINTING OPERATION

BACKGROUND OF THE INVENTION

The present invention relates generally to screen printing and, more particularly, to a method and apparatus for pre-registration of printing screens in a multi-color screen printing operation.

Recently, the screen printing industry has undergone enormous growth, due primarily to the popular appeal of shirts, caps, jackets, and the like bearing printed designs and logos. Screen printing of designs and logos onto articles of clothing is a common practice. Most simply, an article of clothing, such as a T-shirt, is placed upon a flat surface, and a print screen is positioned on the T-shirt. Thereafter, the printing dye or ink is transferred through the screen and onto the T-shirt by means of a roller or squeegee. When a multi-color design is to be printed onto the T-shirt, a set of individual print screens are used, with each print screen being used for application of a different color.

A common problem associated with multi-color printing is the alignment or "registration" of consecutive print screens. Each subsequent print screen must be aligned with the previously different colors are printed sequentially over one another, thereby requiring proper registry between the subsequent screens to achieve a neat, clear, multi-color pattern which can be rapidly and repetitively reproduced in a cost-effective manner.

In custom printing shops, such as those specializing in printing indicia onto T-shirts, as well as other relatively low volume screen printing enterprises, the number of articles to be printed with a particular design at one time is typically very small. Hence, it is preferably that the screen printing machines used on this specialized industry be highly adaptable, and capable of quick change-overs for printing different styles and shapes of articles in a wide variety of multi-colored patterns. Heretobefore, conventional screen printing machines or "screen printers" have not been adapted for pre-registration of print screens. Conventional print screen registration techniques, associated with even the most expensive printing machinery, are complicated, time consuming and manually labor intensive.

The related art to which the present invention is directed teaches many different types of rotary screen printers. As used herein, the term rotary refers to angular displacement of the print screens about a vertical axis when multi-color designs are to be printed. The aforementioned related art generally includes a four-color, one-station screen printer; a four-color, four-station screen printer, a six-color, one-station screen printer; and a six-color, six-station screen printer. All of the foregoing conventional rotary screen printers have the common problem associated with the positioning (i.e. registration of the multi-printing screens. Such multi-color rotary screen printers include multiple screen frame holding assemblies for supporting the print screens bearing different color images. The screen frame holding assemblies extend from a rotary table, and are generally spaced in equal angular fashion about the vertical axis of rotation. One or more platens are disposed below the screen frame holding assemblies. The platens can be fixedly or rotatably supported relative to the rotary table. Generally, the platens are also spaced in equal angular increments about the rotational axis.

Conventional screen frame holding assemblies are equipped with one or more clamping assemblies for securing the print screens thereto. In particular, the print screens are inserted in the clamp assemblies and are thereafter bolted and/or clamped in a desired alignment. However, it is not uncommon for the screen to shift during the printing operation so as to fall out of the desired registration. Printed images in which the color separations are not in accurate alignment results in articles which are not suitable for sale. Furthermore, the initial manual registration procedure is tedious, time-consuming and inefficient, especially in light of the slow output rate and high labor factor associated with small volume runs. Once the desired registration is lost, it is difficult to re-align or re-register the first color pattern on the article subsequent colored patterns.

FIG. 1 is a perspective view of a print screen 10 installed in rear clamp assembly 12 of a pivotable print screen frame holding assembly 14 associated with most conventional screen printers. While a single print screen 10 is illustrated, it is to be understood that the alignment problems to be hereinafter described in greater detail are inherent to all conventional screen printers having any number of pivotable print screen frame holding assemblies 14 and/or any type of clamping assemblies. Print screen 10, the fabrication of which is well known, typically includes a wooden border or frame 16 with a partially imperforate screen 18 mounted tautly to a lower portion thereof. As will be detailed hereinafter in greater detail, and is well known in the screen printing art, print screen frame holding assembly 14 is pivotally movable in a generally vertical plane between an upward "storage" position and a downward "printing" position. In the printing position, screen 18 engages an article which is located on a platen (not shown). The article on which the design or image is printed can include any garment-type products such as shirts, jackets, pants, caps and the like. Furthermore, any relatively flat stock (e.g. window stickers, bumper stickers, signs, decals, etc.) can also be similarly screen printed. Each print screen 10 includes a perforate portion in the shape of a desired image or design 20 through which the printing dye or ink is rolled or squeezed in accordance with application methods known in the screen printing industry.

Print screen 10 is installed in conventional clamp assembly 12 so as to be slid inwardly such that an outer edge surface 22 of frame 16 abuts a clamping surface 24 of rear clamp device 26. Fasteners 28 are adapted to be rotated to tighten a locking member (not shown) into engagement with an upper surface 30 of print screen 10. Typically, clamp assembly 12 further includes side clamps 32 consisting of a C-shaped clamp arm 34, pivotable link 36 and pivot joint 38. Side clamps 32 are provided on opposite ends of rear clamp device 26 and are adapted to pivot inwardly to generally surroundingly capture frame 16. Generally, side clamps 32 are not pivoted into position until print screen 10 has been at least partially aligned relative to the platen such as by fasteners 28 being tightened to secure print screen 54 in rear clamp 26. Link 36 is provided with a slot 40 to accept conventional screens of virtually any width dimension commonly used in screen printing applications. Fasteners 42 extend through slot 40 and an upper portion of C-shaped clamp arm 34 to engage upper surface 30 of frame 16 when tightened. The structure illustrated in association with clamp assembly 12 is exemplary in nature to show the complicated manual alignment technique associated with a registration of a print screen in a conventional print head.

In general terms, the screen printing process, heretobefore known in the industry, is accomplished by bringing (i.e., rotating) screen frame holding assembly 14, having screen frame print screen 10 secured thereto, to a position in alignment with the underlying platen. Print screen 10 is thereafter manually pivoted downwardly to the "printing" position. Screen 18 is urged firmly and abuttingly against the article and a roller or squeegee is used to transfer the dye or ink through screen 18 to print image 20 onto the article. Thereafter, print screen 10 is pivoted upwardly away from the platen to the "storage" position and, in multiple print screen frame holding devices, may be rotated to bring the next print screen over the platen. Thereafter, the above described sequence of steps is repeated for each successive print screen of a multi-color set.

In use, a set of printing screens is selected in accordance with the specific multi-color pattern to be printed onto the article. The print screens are typically designed in sets, with each set including that number of print screens corresponding to the number of different colors which the complete pattern requires. In particular, when several colors are to be printed on the same article, a separate print screen is used for each color, and the colors are printed sequentially over one another, thereby requiring proper registry between the various screens to achieve a neat, multi-colored pattern.

As is readily apparent from reference to FIG. 1, registry of color image 20 with the underlying article supported on the platen requires manual manipulation of print screen 10 relative to rear clamp 26 and side clamps 32 to produce proper alignment. Specifically, prior to tightening fasteners 28 and 42 against upper surface 30 of print screen 10, screen 18 must be properly aligned. The operator is required to manually align print screen 10 relative to clamp assembly 12 to align color image 20 into proper registration with the article. Typically, the operator is required to visually align image 20 which entails moving print screen 10 for and aft, sideways and/or angularly, relative to the rear clamp device 26. Side clamps 32 are thereafter pivoted into engagement with frame 16 of print screen 10 to provide additional rigidity and support. However, the original alignment of print screen 10 in clamp assembly 12 may be disturbed during normal printing operation thereby destroying the proper registration. Once this registration is lost, it is difficult to accurately re-align or "re-register" a particular color image on the article with subsequent color images. Although it is possible to re-register the subsequent multi-color printing screens, such a process is extremely inefficient and time consuming, thereby greatly increasing production costs. In particular, custom printing shops, specializing in relatively low volume runs, have herebefore been hampered by excessive set-up times for minimal order requirements.

SUMMARY OF THE INVENTION

In its broadest aspect, the present invention provides both a novel apparatus and method directed to providing means for registration of print screens for application to multi-color screen printing of apparel-type articles.

It is a primary object of the present invention to provide a print screen registration apparatus adapted to be universally accepted into the print screen frame holding assembly clamp assembly of most conventional screen printers. Initial alignment of the registration apparatus relative to the conventional print screen frame holding assembly clamp assembly generates accurate registration of any multiple of pre-registered print screens thereafter inserted into the registration apparatus. The registration apparatus is modular in construction, economical to manufacture, easy to install in conventional screen printers and efficient in use.

It is another object of the present invention to provide a print screen registration apparatus adapted to accept virtually any size print screens. Similarly, the apparatus is capable of being selectively adjusted for "fine-tuned" registration without disturbing the initial alignment of the registration apparatus in the print screen frame holding assembly.

It is a further object of the present invention to provide an improved multi-color screen printer incorporating the principles of the registration apparatus therein.

Furthermore, the present invention provides for a method of pre-registering a series of color-separation images relative to one another, prior to mounting in a print screen, whereby the print screens are pre-registered relative to one another for simple installation into the registration apparatus or the improved screen printer.

These and many other important advantages of the invention will be further understood and appreciated by those skilled in the art by reference to the following specification, claims, and the appended drawings.

BRIEF DESCRIPTION OF THE DRAWINGS

FIG. 8 illustrates a modification to the print screen registration apparatus of FIG. 6 adapted to provide "fine-tuning" registration adjustment capabilities;

FIG. 9 is an exploded perspective view of the components illustrated in FIG. 8;

DETAILED DESCRIPTION OF THE PREFERRED EMBODIMENTS

Figure 1:
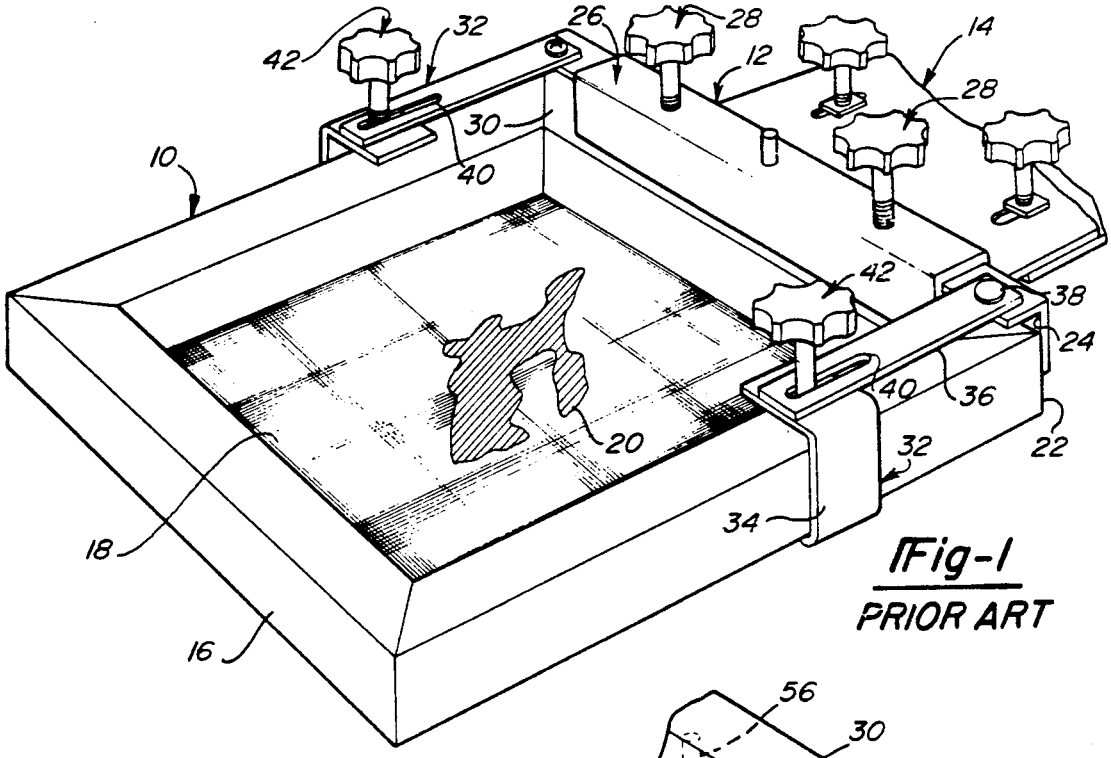
Fig-1 PRIOR ART
FIG. 1 is a perspective view of a print screen installed in a clamp assembly of a conventional screen printer.
Figure 2:
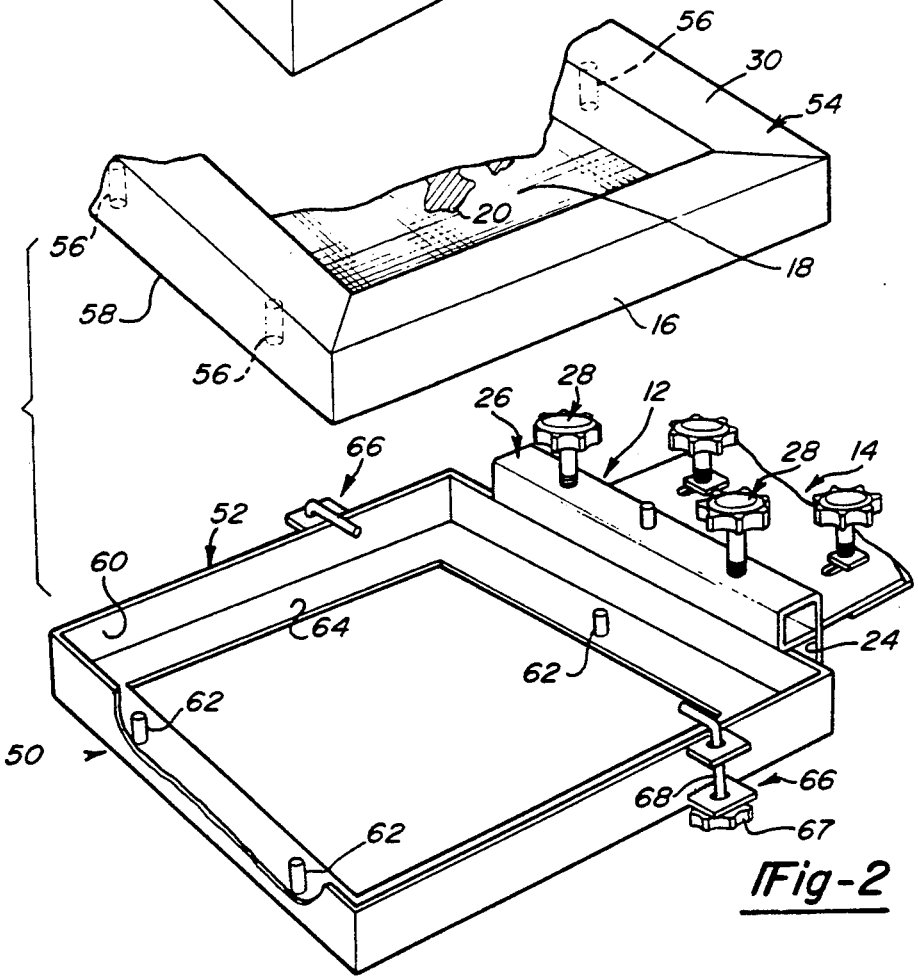
FIG. 2 is an exploded perspective view of a print screen registration apparatus according to one embodiment which is installed in a clamp assembly of a conventional screen printer.

Referring to FIGS. 2 through 5, an embodiment of the present invention is illustrated. For purposes of clarity, like numbers are hereinafter used to identify like components previously described. It is also to be understood that the following embodiments are merely exemplary in nature and are not to be interpreted to limit the present invention.

In general, a print screen registration apparatus 50 is disclosed which is universally adaptable for retro-fit installation in clamp assembly 12 of print screen frame holding assembly 14. Registration apparatus 50 includes a generally square housing 52 having an inner wall area adapted to receive print screen 54 therein. While housing 52 is shown as being generally square in configuration, it is contemplated that it may be of any shape suitably adapted to be used with conventional print screens of virtually any size and shape. Furthermore, print screen 54 is substantially similar to print screen 10 except for upstanding registration apertures 56 extending from a lower surface 58 of frame 16. As will be hereinafter described, apertures 56 can be associated with frame 16 of any existing print screen so as to be adapted for use with the present invention.

Print screen 54 has a plurality of elongated apertures 56 extending from opposite parallel sides of lower surface 58 of frame 16 associated with print screen 54. While apertures 56 are illustrated as extending from opposite parallel sides of frame 16, it is to be understood that any combination of two or more apertures located along lower surface 58 is suitable. Furthermore, apertures 56 are easily drilled into print screen 54 in a desired pattern through application of a standardized drill jig 57. The drill jig 57 (see FIG. 13) would properly align the positioning of apertures 56 relative to lower surface 58 of frame 16 prior to the drilling thereof. It is contemplated that drill jig 57 would be made available with registration apparatus 50 as part of a complete retro-fit conversion system. Likewise, it is contemplated that such a conversion system could include angled support members (see FIG. 14) adapted for mounting to a print screen 54 as an alternative to modification through use of jig 57.

Apparatus 50 preferably is rigid, being made of an angled, relatively lightweight material. Apparatus 50 includes an upstanding peripheral rim 60 and a number of registry pins 62 extending from a radially inwardly extending peripheral floor or flange surface 64. Preferably, the number and spacing of registry pins 62 correspond to the number and spacing of apertures 56 provided in frame 16. Flange surface 64 is planar and adapted to support lower surface 58 of print screen 54 thereon.

Preferably, once registration apparatus 50 is secured within clamp assembly 12 in a desired orientation, installation of a print screen 54 into apparatus 50 acts to register pins 62 into apertures 56 such that print screen 54 is thereafter in proper alignment with the underlying article to be printed. Therefore, each distinct color image in the set of print screens, having been previously pre-registered relative to apertures 56 associate with its respective frame 16, and in accordance with an image pre-registration method to be hereinafter described, can be easily inserted into apparatus 50. In particular, consecutive print screens 54 of a set can be easily "snapped" in and out of the registration apparatus for quick change-over between print screens. In this manner, a conventional screen printer, regardless of the number of stations or print heads can be universally retro-fit with registration apparatus 50.

Registration apparatus 50 further includes side clamps 66 which are provided for rigidly securing print screen 54 against flange surface 64 of apparatus 50 to eliminate any undesirable wobble or "ghosting" during the screen printing operation. Side lamps 66 are shown as including a L-shaped clamp bar 68 which can be loosened or tightened by rotation of handle 67. Furthermore, clamp bar 68 can be rotated outwardly to allow installation of print screen 54 and thereafter rotated inwardly to surroundingly capture screen 54 within apparatus 50. However, it is contemplated that any suitable clamping device known in the screen printing industry is readily adaptable to the present invention to provide the requisite rigidity.

Figure 3:
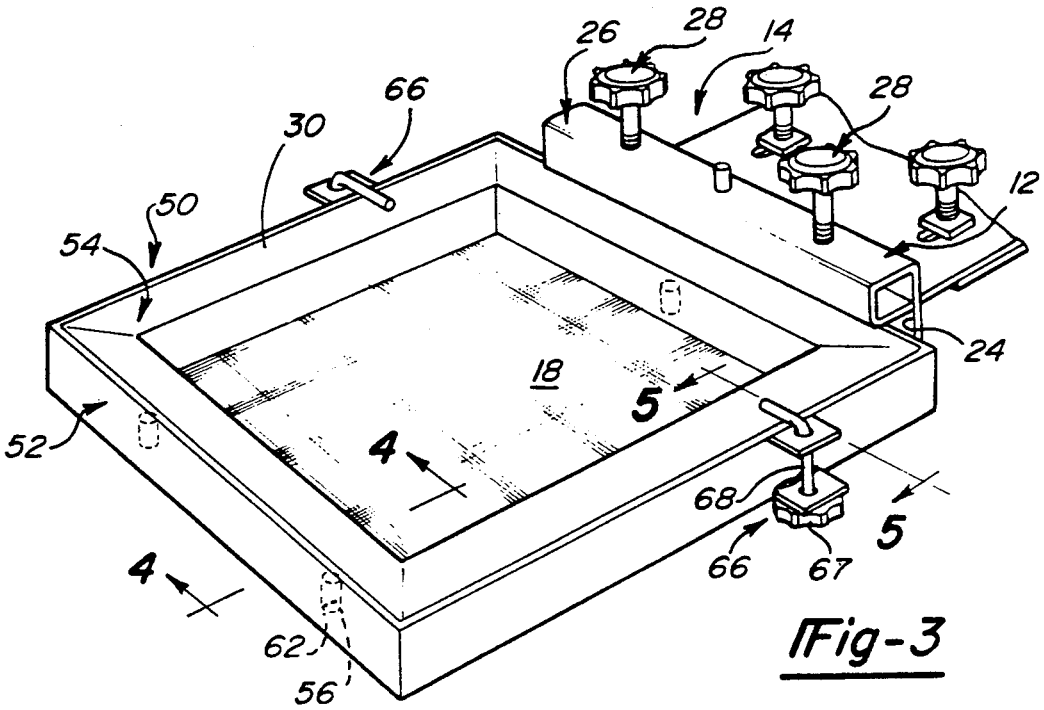
FIG. 3 is similar to FIG. 2 except that a print screen is shown inserted in the print screen registration apparatus of the present invention.
Figure 4:
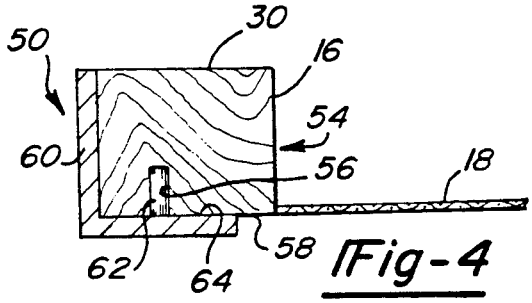
FIG. 4 is an enlarged cross-sectional view taken along line 4—4 of FIG. 3.
Figure 5:
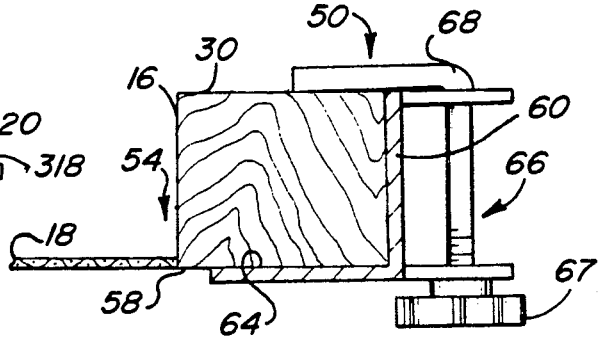
FIG. 5 is an enlarged cross-sectional view taken along line 5—5 of FIG. 3.

FIG. 3 illustrates print screen 54 installed in registration apparatus 50 with registration pins 62 in registry with apertures 56 and showing side clamp 66 engaging top surface 30 of frame 16 to securely bias lower surface 58 against flange surface 64. FIG. 4 is a cross-section of FIG. 3 illustrating the registration of pin 62 in aperture 56. In addition, FIG. 5 illustrates the clamping association of side clamp 66 relative to top surface 30 of frame 16.

Figure 6:
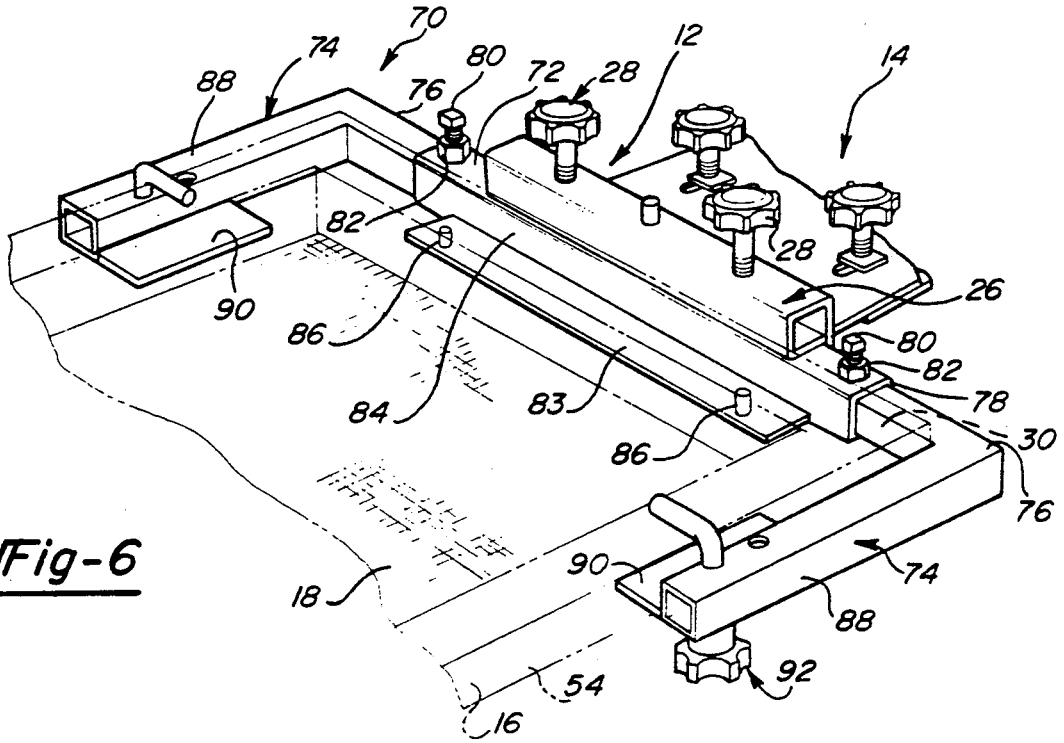
FIG. 6 is a perspective view of a print screen registration apparatus according to another embodiment of the present invention.
Figure 7:
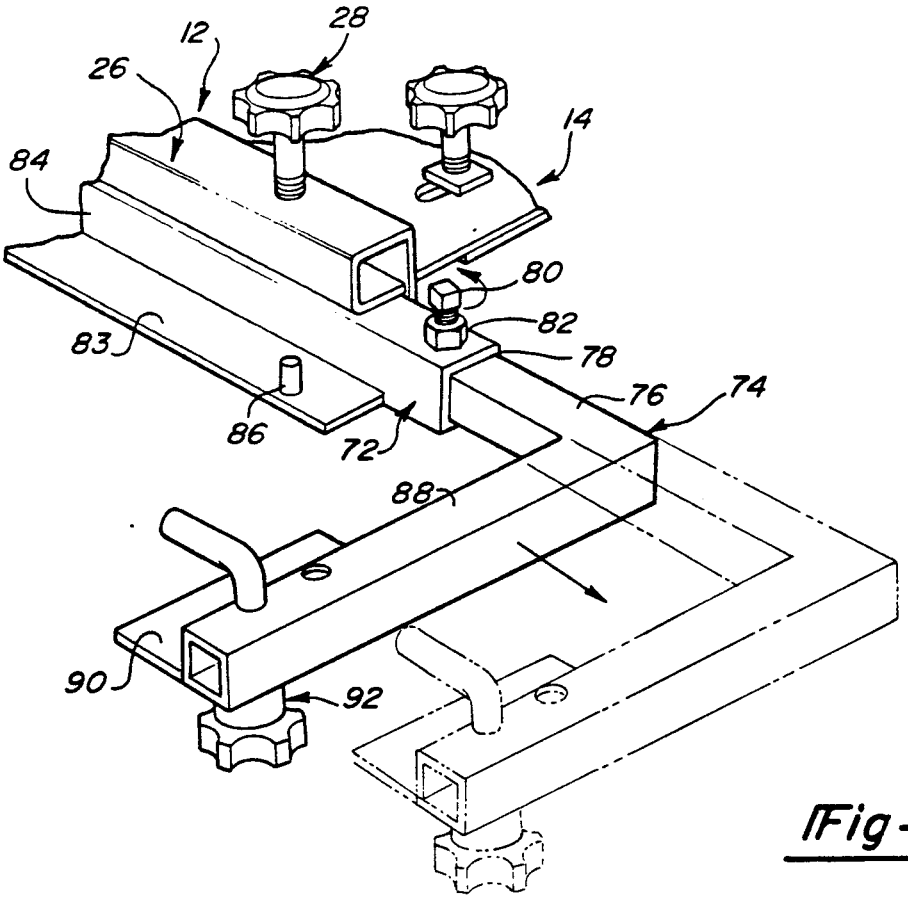
FIG. 7 illustrates the adjustment capabilities of the embodiment shown in FIG. 6 for various sized print screens.

Referring now to FIGS. 6 and 7, another embodiment of the present invention is illustrated. Print screen registration apparatus, designated as reference numeral 70, is likewise initially aligned relative to conventional clamp assembly 12 of a print head 14.

Print screen registration apparatus 70 includes an elongated tubular rear frame member 72 adapted to be mounted within rear (or side) clamp device 26 of clamp assembly 12. Tubular rear frame member 72 is illustrated as having a generally square cross-section configuration to facilitate proper orientation and alignment within rear clamp 26. Tubular frame member 72 is preferably of a sufficient length to extend from opposite ends of rear clamp 26.

Print screen registration apparatus 70 includes a pair of mirror-imaged telescopically movable L-shaped side arms 74. L-shaped side arms 74 have a first leg portion 76 adapted to be slidingly received within the opposite open ends 78 of tubular frame member 72. The telescopically movable L-shaped side arms 74 provide dimensional adjustability to permit installation of various sized print screens 54 within registration apparatus 70. Means for securing first leg portion 76 relative to tubular member 72 are provided for properly adjusting registration apparatus 70 to a desired width dimension. Such means are shown as a bolt 80 threadably engaging nut 82 which is secured to frame member 72. Bolt 80 passes through nut 82 and a bore (not shown) through frame member 72 to engage a top surface of first arm 76. Tightening of bolt 80 acts to secure side arm 74 in the desired telescopic position.

Tubular frame member 72 has a outwardly extending lower elongated shoulder or flange 83 secured transversely to an upstanding surface 84 thereof. Flange 83 is provided with at least two registry pins 86 for registration within apertures 56 of print screen 54 and to support lower surface 58 of print screen 54 thereon as herebefore described in reference to the first embodiment. Second arm 88 of L-shaped side arms 74 also include flanges 90 on which lower surface 58 of print screen 54 rests upon installation of print screen 54 in registration apparatus 70. It is contemplated that additional registering pins may be mounted on flanges 90 as required. Side arms 74 further include side clamp assemblies 92 for securing print screen 54 in generally rigid fashion to registration apparatus 70. Registration apparatus 70 is initially aligned and secured relative to clamp assembly 12 of conventional print screen frame holding assembly 14 such that insertion of print screen assembly 54 into apparatus 70 with registration of pins 86 in apertures 56 aligns image 20 in the desired orientation.

FIG. 7 illustrates the telescopic adjustability characteristics of side arms 74. It should be understood that print screen 54 is a conventional screen which has been modified to include apertures 56 in lower surface 58. Therefore, pre-registration apparatus 70 is adapted to be used with conventional screens of virtually any size and shape and can be adjusted as shown in FIG. 7. Furthermore, it should be understood that print screen 54 can be of any conventional known fabrication such as from wood, aluminum, steel, or any other frame material which can be readily modified (i.e. drilled) to define apertures 54 adapted to accept registry with pins 86.

Referring now to FIGS. 8 and 9, a modification to the last described embodiment is shown. Particularly, in those instances where slight "fine-tuning" alignment of print screen 54 may be necessary, the present invention includes means for such adjustment which can be accomplished without disturbing the original alignment of print screen registration apparatus 100 within clamp assembly 12. Preferably, registration apparatus 100 is substantially identical to that illustrated in FIGS. 6 and 7 except that the registry pins can be simultaneously moved to selectively adjust for small mis-alignments. In particular, rear elongated tubular member 72 has an outwardly extending elongate flange 102 adapted to receive and support lower surface 58 of print frame 54 upon installation into apparatus 100. Elongated flange 102 includes two spaced apertures 104 extending through flange 102. Inwardly of, and in close proximity to, apertures 104 are threaded studs 106 extending transversely from a lower surface of flange 102. An adjustment arm having a pair of registration pins 110 corresponding generally in location to apertures 104 is provided. The pins 110 are spaced so as to be adapted for receipt into apertures 56 of a print screen 54. Adjustment arm 108 further includes a second pair of apertures 112 spaced to receive threaded studs 106 therethrough. Threaded locking handles 114 are also provided which threadedly engage studs 106 to assemble the components.

As is shown in FIG. 9, adjustment arm 108 is installed below flange 102 such that pins 110 extend through first apertures 104 while studs 106 extend through second apertures 112. Thereafter, locking handles 114 are threaded onto the studs 106. When locking handles 114 are rotated to be generally loosened on studs 106, the relative location of pins 110 confined within aperture 104 can be moved in various degrees of freedom to permit slight alignment or "fine-tuning" of print screen 54 mounted within apparatus 100. As is apparent, pins 110 move simultaneously. Once the "fine-tuned " alignment is made, locking handles 114 are rotated in a direction to tighten them on studs 106 such that the alignment of print screen 54 is as desired. Thereafter, side arm 74 are telescopically adjusted such that the side clamps (not shown) can be secured to the print screen.

It is to be understood that each embodiment described is universally adapted to be retro-fit into any conventional stationary or rotary screen printer. Therefore, the present invention substantially reduces the time required for set-up of a multi-color job while inhibiting misalignment during the printing operation. Print screens 54 can be readily snapped into, and out of, the present invention to provide simple interchangeability between successive print screens. In particular, the various embodiments of the print screen registration apparatus are directed to substantially eliminating problems associated with multi-color, single-station operations. In the past, the operator of a conventional screen printer had to manually align each successive screen image relative to the previous images to register the latter screens with the former screens. The present invention permits "snap-in" installation of the print screens to provide precise registration. Now, single-station screen printers can be used efficiently and cost effectively for printing multi-color articles by sequentially installing each print screen within the registration apparatus. Conventional manual registration of each screen relative to the platen is therefore substantially eliminated.

Figure 10:
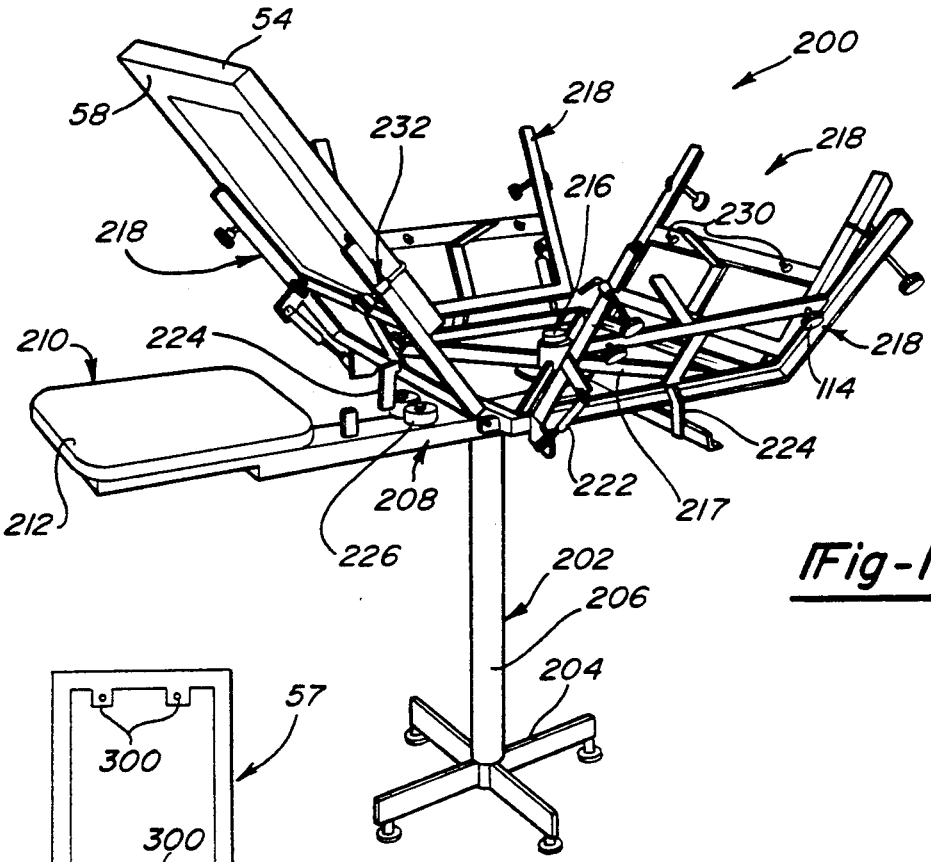
FIG. 10 is a multi-color, single station screen printer apparatus incorporating the print screen registration principles of the present invention.

Referring now to FIG. 10, a screen printer device 200 incorporating the print screen registration principles of the present invention is illustrated. In particular, screen printer 200 is a structural embodiment of an improved multi-color, single-station rotary screen printer. Screen printer 200 includes a pedestal assembly 202 that includes a base section 204 and a vertical column 206 extending upwardly from base section 204. Extending from an upper end of vertical column 206 is a generally longitudinally extending rail or frame member 208 having at one of its ends a printing station assembly 210. printing station assembly 210 includes a platen 212 on which the article to be printed is aligned. It is contemplated that platen 212 can be readily detachable to be oriented or aligned in any desired orientation.

Extending upwardly from an opposite end of frame member 208 is a rotary assembly 216 having a plurality of pivotable print screen frame holding assemblies 218 equally spaced radially therearound. Preferably, rotary assembly 216 has a central hub 220 which defines a vertical axis about which the multiple print screen frame holding assemblies 218 are mounted for rotation. While the vertical axis is illustrated as extending offset from and parallel to pedestal assembly 202 it is contemplated that the axis may be concentric with vertical column 206. Since the structure and bearings that support rotary assembly 216 on hub 220 are well known in the art, and since they do not form any part of the present invention per se, they are not illustrated. Print screen frame holding assemblies 218 may be pivoted from a "storage" position (shown) to a generally longitudinal "printing" position (not shown) in abutting relationship to platen 212. It is contemplated that following the printing operation, print screen frame holding assemblies 218 can be easily pivoted to the "storage" position. A pneumatic device 222, or any other suitable means commonly employed in screen printers, is provided to bias each print screen frame holding assembly "storage" position to inhibit inadvertent downward pivoting of the print screen frame holding assemblies. Preferably, rotary assembly 216 includes support structure 217 which lends rigidity and integrity to screen printer 200 during pivotal motion of the print screens.

Screen printer 200 includes a guide stop 224 associated with each pivotable print screen frame holding assemblies 218 and a pair of rollers 226 mounted to frame member 208. When a print screen frame holding assembly is rotated around the vertical axis relative to printing station assembly 210, guide stop 224 acts to accurately position print screen 54 in a predetermined angular relationship relative to platen 212. As illustrated, rollers 226 are spaced apart a distance substantially commensurate with the width of guide stop 224 such that guide stop 224 may be slidably received therebetween. Guide stop 224 is provided on print screen frame holding assembly 218 outwardly of rollers 226 such that when a print screen is pivoted to the "storage" position the print screen frame holding assembly may be rotated around hub 220. When a print screen is pivoted downward toward the "printing" position, in order for the print screen to abut the article on platen 212, print 218 must be rotated in a manner to position guide stop 224 between rollers 226. If print screen frame holding assembly 218 is not so rotated, guide stop 224 will contact rollers 226 to prevent the print screen from engaging the article. When guide stop 224 is properly positioned between rollers 226, the print screen may be pivoted downwardly into abutting relationship with the article, thereby simultaneously fixing the angular position of print screen frame holding assembly 218 and print screen 54 with respect to platen 212 to achieve accurate angular registry.

Print screen frame holding assemblies 218 of screen printer 200 include registry pins 230 adapted to be received in apertures 56 of print screen 54 upon installation. FIG. 10 illustrates a single print screen 54 clamped rigidly to one of the print screen frame holding assemblies via side clamps 232. However, as is apparent, any number of the available print screen frame holding assemblies 218 can be used depending on the number of print screens in the set. As is also illustrated, pins 230 include the "fine-tuning" structure described in reference to FIGS. 18 and 9. That is, pins 230 are slightly movable to correct for any minute registration accuracies.

Screen printer 200 is illustrated with a multiplicity of four print screen frame holding assemblies 218 and a single printing station assembly 210. Generically, such a device is identified as a multi-color, single-station screen printer. It is to be understood that the present invention is not to be interpreted to be limited to the structure shown in FIG. 10. Particularly, it is contemplated that the screen printer of the present invention includes all combinations of multiple or single stations and print screen frame holding assemblies which incorporate the principles of the present invention Furthermore, while printing station assembly 210 is illustrated in FIG. 10 as being fixed, it is also contemplated that any plurality of printing stations may be independently rotatable relative to pedestal assembly 202 about a common or second vertical axis for high-speed systems.

Figure 11:
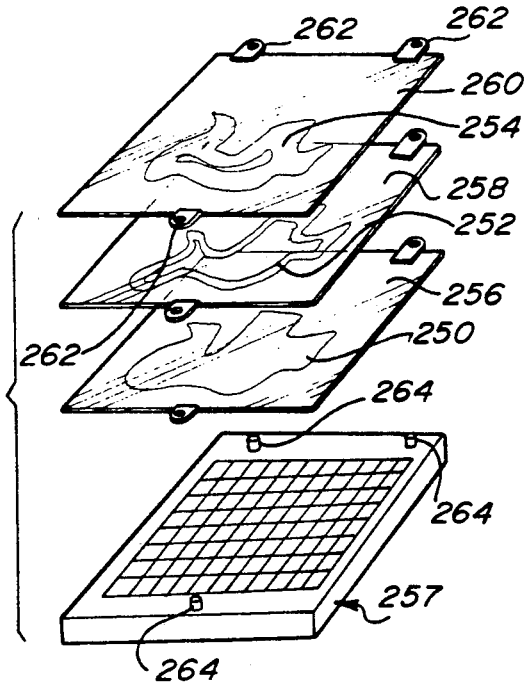
FIG. 11 schematically illustrates the method of pre-registering successive images prior to installation in a print screen.
Figure 12:
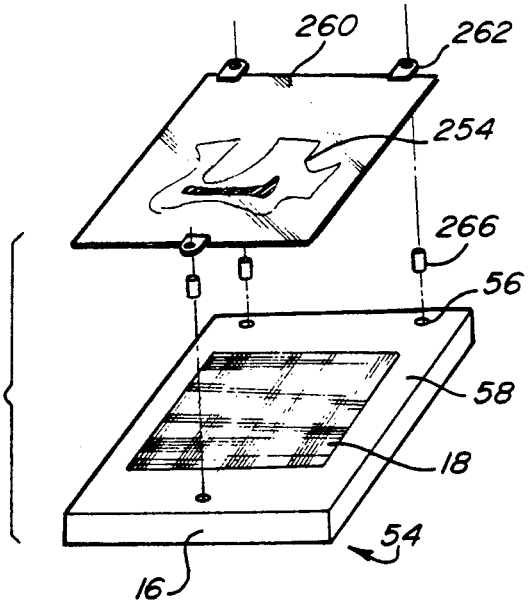
FIG. 12 illustrates alignment of one of the pre-registered color images relative to the print screen.

Referring now to FIGS. 11 and 12, a method for pre-registration of a set of successive patterns, designs, images, or the like, prior to photoresistive processing of screen 18 is illustrated. The images on screens 18 of a set of print screens 54 are pre-aligned and registered relative to one another prior to installation into a print screen registration apparatus 50, 70 and 100, or screen printer 200. Such pre-registration of successive patterns substantially eliminates the time-consuming and manual alignment associated with conventional systems.

Referring to FIG. 11, a method of pre-registering a multiplicity (three shown)) of images or pattern positives 250, 252, and 254 to separate transparencies 256, 258 and 260, respectively, is disclosed for defining a set of three different color images to be photoresistively transferred to separate print screens.

According to the preferred method, first transparency 256 is attached to set-up board 257. In particular, tabs 262 corresponding to the number and spacing of apertures 56 on print screen 54 are mounted over pins 264 of set-up board 257. A first pattern positive 250 is aligned and secured to first transparency 256. Thereafter, second transparency 258 is overlaid on set-up board 257 and second pattern positive 252 is aligned relative to first positive 250 and is then secured to second transparency 258. Again, repeating the previous operation, third transparency 260 is mounted in overlying fashion to the first and second transparencies such that third pattern positive 254 is secured to third transparency 260 so as to be aligned relative to first and second positives 250 and 252, respectively.

Thereafter, each of the transparencies is removed from set-up board 257 and mounted to back surface 58 of a print screen 54 (see FIG. 12). In particular, tabs 262 are aligned with apertures 56 and are secured relative thereto by dowel pins 266. Thereafter, screen 18 is photoresistively processed to transfer or "burn" the pattern onto the screen. In this manner, a pre-registered set of print screens is provided which are now adapted for quick installation into the print screen registration devices heretobefore described. This method can be repeated to produce a set of print screens having any number of distinct images and/or colors.

Figure 13:
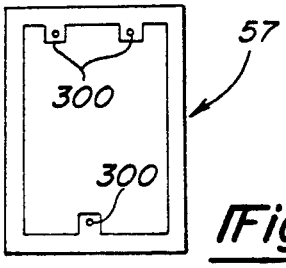
FIG. 13 illustrates a jig apparatus which is adapted for modifying conventional print screens prior to installation into a registration device.

FIG. 13 illustrates jig 57 in greater detail. In general, jig 57 is a generally rigid device adapted to be mounted in contiguous abutting relation to lower surface 58 of a conventional print screen, such as herebefore designated as reference numeral 10 in FIG. 1. Jig 57 includes a plurality of locator holes 300 which correspond in number and position to the registry pins associated with the various registration apparatus embodiments described herebefore. Thereafter, apertures 56 are bored into lower surface 58 of the print screen through locator holes 300. In this manner, conventional print screens can be quickly and accurately modified for use with the present invention.

Figure 14:
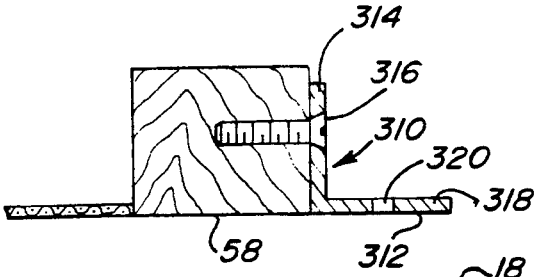
FIG. 14 illustrates an L-shaped support apparatus for modifying conventional print screens.

FIG. 14 illustrates angled support members 310 in greater detail. In general, L-shaped support members 310 are adapted to be mounted to frame 16 of print screen 54 in such a manner to have a lower surface 312 located in the same plane as screen lower surface 58. Support member 310 is shown as having a first portion 314 secured (as by screw 316) to the outer peripheral surface of frame 16. Second portion 318 is transverse to and radially outward of first portion 314 and is provided with a registration hole 320 sized to accept receipt of the registration pins associated with any of the various embodiments herebefore described. In this manner, conventional print screens can be modified for use with the present invention without using jig 57 for drilling apertures 56 directly into the print screen.

The foregoing discussion discloses and described merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A multicolor screen printing apparatus comprising:

a support base, a vertical support column, a rotary assembly having a support frame assembly, said support frame assembly having a plurality of screen frame holding assemblies attached thereto, a print station assembly having a platen and a rail member extending from said support frame assembly, means to rotate said rotary member to position successively each of said screen frame holding assemblies in a desired position overlying said platen, a pair of rollers coupled with said rail member, said screen frame holding assemblies each having a plurality of register pins and screen frame holding clamps, said plurality of screen frame holding assemblies each having a guide stop means attached thereto for engagement in between said pair of rollers to locate the screen frame holding assemblies in said desired position overlying said platen, said screen holding assemblies each having moving means to move said screen frame holding assembly from an upright rest position to a horizontal print position, a plurality of screen frames each having a plurality of registration apertures positioned so that said registration apertures engage with said plurality of registration pins on said screen frame holding assemblies.

2. The multicolor screen printing apparatus of claim 1 wherein said screen frame holding assemblies comprise a rectangular housing having a rectangular side rim and a rectangular bottom flange means, said bottom flange means having said registration pins attached thereto to engage said registration pins in said registration apertures in said screen frames.

3. The multicolor screen printing apparatus of claim 2 wherein said screen frame holding clamps comprise L-shaped clamp bar means and handle means for tightening said L-shaped clamp bar means to clamp a top surface of said screen frame and engage a bottom surface of said screen frame against said bottom flange means.

* * * * *